US005642939A

United States Patent [19]

Comardo

[11] Patent Number: 5,642,939

[45] Date of Patent: Jul. 1, 1997

[54] LIQUID MIXING, CONVEYING AND CIRCULATING SYSTEM FOR PULVERULENT MATERIAL

[76] Inventor: Mathis P. Comardo, 5301 Nolda, Houston, Tex. 77007

[21] Appl. No.: 639,313

[22] Filed: Apr. 24, 1996

[51] Int. Cl.[6] ..... B01F 15/02

[52] U.S. Cl. ..... 366/132; 366/137; 366/138; 366/163.2

[58] Field of Search ..... 366/132, 136, 366/137, 138, 143, 159.1, 162.1, 163.1, 163.2, 182.3, 182.4

[56] References Cited

U.S. PATENT DOCUMENTS

| | | | |
|---|---|---|---|
| 4,007,921 | 2/1977 | Zingg | 366/136 X |
| 4,100,614 | 7/1978 | Mandt | 366/163.2 X |
| 4,210,166 | 7/1980 | Munie | 366/163.2 X |
| 4,863,277 | 9/1989 | Neal et al. | 366/136 X |
| 5,344,619 | 9/1994 | Larwick et al. | 366/163.2 X |
| 5,348,390 | 9/1994 | Schertenleib | 366/136 |

FOREIGN PATENT DOCUMENTS

| | | | |
|---|---|---|---|
| 55-114337 | 9/1980 | Japan | 366/163.2 |
| 4-141226 | 5/1992 | Japan | 366/163.2 |

*Primary Examiner*—Charles E. Cooley
*Attorney, Agent, or Firm*—Bush, Riddle & Jackson, L.L.P.

[57] ABSTRACT

Apparatus and method for unloading a fine powder-like pulverulent material from bags and mixing it with a liquid carrier in preparation for its use, while at the same time minimizing the potential for liberation of the particulate into the environmental air. Very finely particulate or flour-like pulverulent material is transferred by dumping it into a hopper. The pulverulent material is then mixed with a liquid carrier by a venturi that is located within a valve controlled, pump energized liquid circulation conduit system having connection with a supply vessel to circulate the mixture within the circulation vessel and supply vessel and thereby maintain an efficient liquid/pulverulent mixture that it is readily available for use. To minimize the potential for development of a potentially explosive or otherwise hazardous condition as the powder-like pulverulent material is transferred by dumping into the hopper of the system, the hopper is provided with an air by-pass system that is responsive to suction of the venturi to maintain the hopper under negative air pressure so that any pulverulent material that might have become entrained in the environmental air during material dumping will be drawn toward the bottom outlet of the hopper. Electronic control circuitry of the system ensures its timed and controlled operation and ensures that, if the system should shut down for any reason, a system flushing sequence must run to its completion to restore it to a clean condition for efficient use.

12 Claims, 5 Drawing Sheets

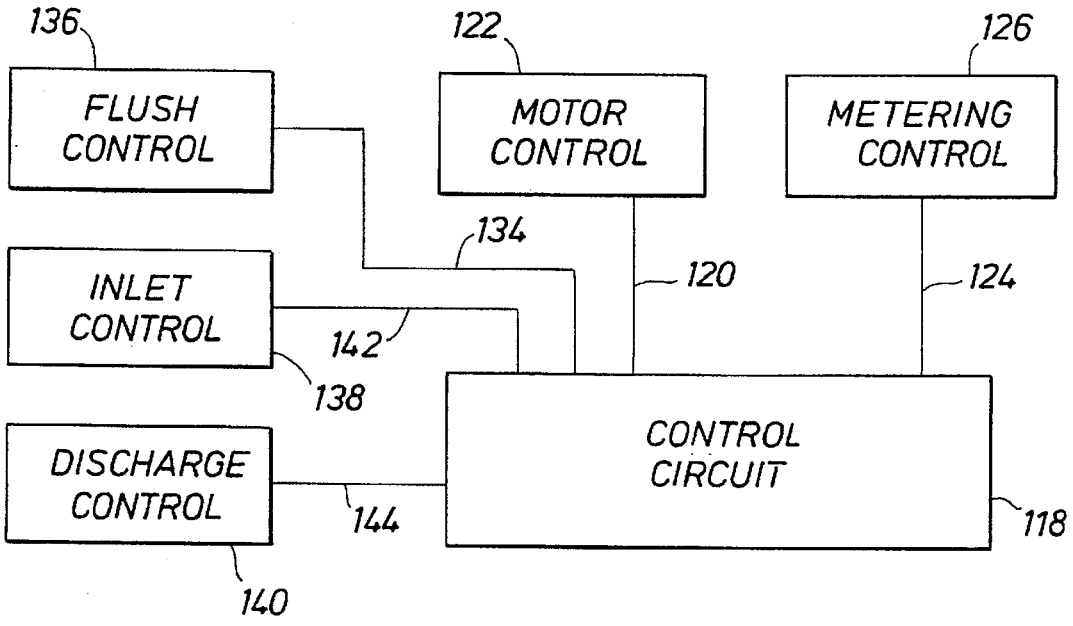
FIG. 4
FIG. 6
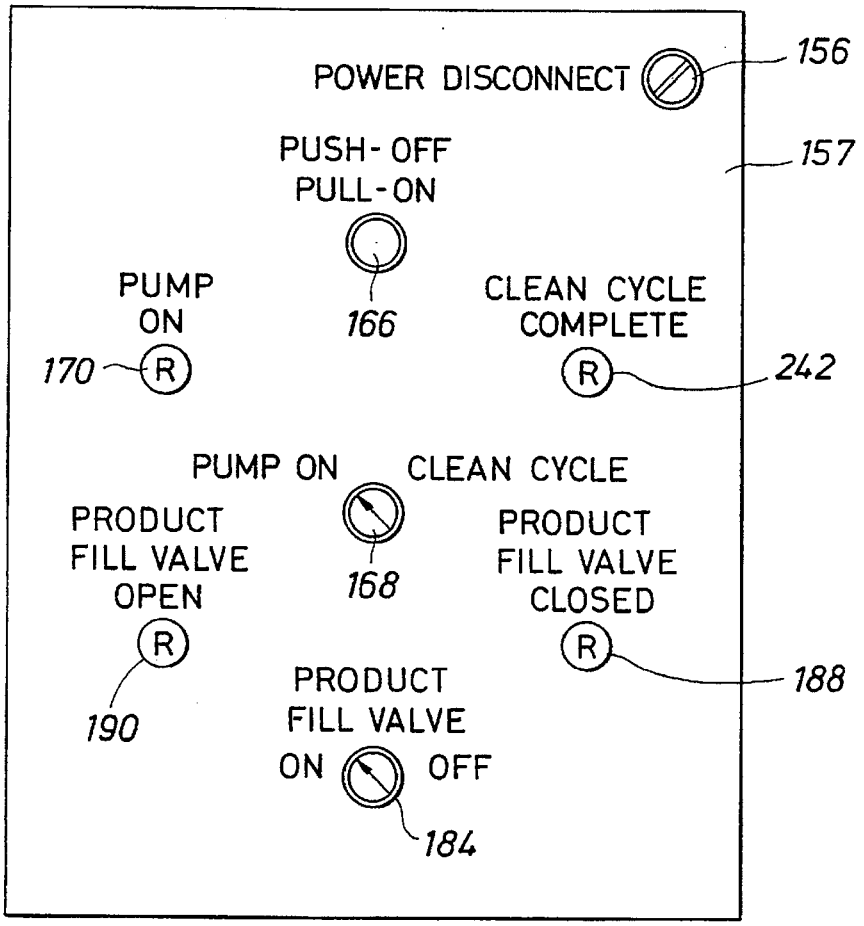

LIQUID MIXING, CONVEYING AND CIRCULATING SYSTEM FOR PULVERULENT MATERIAL

FIELD OF INVENTION

This invention relates generally to apparatus and method for unloading a pulverulent material from containers and conveying it to a remote site for use. More specifically, the present invention concerns the unloading and conveying of a very finely particulated or flour-like pulverulent material from large flexible bags by mixing the same with a liquid carrier and circulating the same within a liquid mixture supply tank and within a liquid circulation conduit system to maintain an efficient liquid/particulate mixture so that it is readily available for use. Even more specifically the present invention concerns the handling of a potentially explosive or otherwise potentially hazardous powder-like pulverulent material so that the pulverulent material does not become entrained in environmental air during the handling, unloading and mixing process and so that workers handling the pulverulent material during dumping and mixing activities are protected from exposure to air entrained particulate.

BACKGROUND OF THE INVENTION

Though the present invention is described herein particularly as it relates to the handling of a finely pulverized solid material, polyvinyl alcohol (PVA), which is widely used at this time as a binder during the paper manufacturing process, to enable ready understanding of the invention it is not intended to restrict the present invention to methods and apparatus for handling PVA. It is within the spirit and scope of the invention to provide for handling and conveying of a wide variety of pulverulent materials of flour-like or dust-like consistency, to insure that environmental air in the immediate vicinity of the pulverulent material handling system remains substantially free of contact with the pulverulent material being handled and are also protected from potentially breathing air that might be laden with the fine particulate.

In the manufacture of paper a binder agent in the form of a finely comminuted solid material is typically mixed with a carrier liquid, typically water, so that the paper fibers can be bound in sheet form when screened, rolled and dried. In the past various binder agents such as corn starch have been comminuted to a fine powder-like or flour-like form and mixed with a carrier liquid to form a binding mixture. Paper fiber is then introduced to the binder mixture and is then subjected to screening to define sheet paper that is subjected to rolling and drying to complete the paper manufacturing process. Of late it has been found that polyvinly alcohol (PVA) functions as a paper fiber binder of exceptional quality for the manufacture of paper and various paper-like products. Typically powdered PVA is brought to the general site of its use in small transport bags capable of handling 50 pounds or so of the flour-like pulverulent material. Typically, the bagged material is transported to the mixing site and the bags are manually cut and the material is dumped directly into a typically large mixing vessel containing a quantity of carrier liquid. After thorough mixing by stirring the mixture is pumped or otherwise conveyed to a typically adjacent site where the paper fiber is mixed with it or it is mixed with paper fiber. It is well known that when the fine powder-like binder is poured from the bags into the liquid carrier a quantity of the fine particulate does not enter the liquid, but rather becomes entrained in the environmental air of the building housing the mixing process because it must pass through the air to the liquid. Alternatively, in the past the binder material has been unloaded from bags in its dry state and conveyed to a mixing site. In this case the pulverulent material is unloaded from bags into a hopper and is then conveyed in dry pulverulent form to a mixing facility located at the site of its intended use, where it is then conveyed into a mixing vessel and mixed with a liquid carrier agent. The liquid binder and carrier mixture is then conveyed from the mixing site to a paper manufacturing process in liquid form where the paper fibers are mixed with it.

It has been determined that handling of the dry, finely comminuted particulate during its dumping from bags and during its mechanical conveying to a site for mixing can create hazards to workers. If the flour-like particulate should constitute a health hazard to workers, if breathed, or if skin contact occurs, the workers must then be provided with appropriate equipment to ensure their isolation from the material. Such is, of course, an undesirable condition, not only because of the potential hazards to workers but also since the cost of the process is materially increased by the requirement for expensive protective equipment for the workers. In some cases a finely comminuted pulverulent material, though not an any manner hazardous when contained in bags, nevertheless can become quite dangerous from the standpoint of explosion when it is entrained in the environmental air of a closed manufacturing facility. Coal mine explosions are a well known example of the explosive nature of coal dust in the closed environments of underground coal mines. It is desirable therefore to provide for unloading and conveying of finely comminuted pulverulent materials in a manner that minimizes the potential for entrainment of the material in the environmental air of a mixing facility and therefore does not constitute a hazard to workers and does not add materially to the cost of the process.

Since PVA, being a rather dense solid, has a tendency to separate from its solution with water, it is highly desirable to maintain the water/PVA mixture in a state of continuous movement or circulation to maintain the pulverulent material in efficient solution and therefore maintain the desirable properties of the mixture until its use. Further, if the process is shut down for any reason, since settling of the solid particulate will occur within a fairly short period of time, it is desirable that the efficient character of the mixture be restored prior to its use in a paper manufacturing process.

When bags of PVA are opened and poured into a water containing vessel in a conventional manner a minute portion of the PVA will typically become airborne in the environmental air near where the mixing process is being conducted. When the PVA is so airborne, depending upon the quantity of pulverulent material being entrained into the environmental air, a potentially explosive air/powder mixture can result. In this regard it should be born in mind that many other pulverulent materials may also develop an explosive mixture when airborne in a closed environmental region such as the air within a processing building. It is highly desirable therefore to provide a novel system for the mixing of pulverulent PVA or other pulverulent materials with water or other carrier liquids in such manner that the pulverulent material does not become entrained in the environmental air so that an explosive condition is avoided.

It has been determined that PVA and other pulverulent materials may be delivered for mixing with water by means of large bulk bags which may contain as much as 1000 pounds or so of the pulverulent material. These large bulk bags are provided at one end with lifting loops to enable the filled bag to be lifted by an overhead crane, by a fork lift truck or by other hoist apparatus. A bulk bag that is suspended above a receiving hopper with its lower end located near the bottom of the hopper is then opened at its bottom to permit gravity feed of the pulverulent material from the bag into the hopper. Obviously, if the bag is merely opened at its lower end so that its contents can be deposited within a hopper for further processing, the environmental air can become contaminated as the pulverulent material passes through the air and into the hopper. Though such seldom occurs, a sufficient amount of the particulate may become entrained in the air to a point that an explosive mixture can result in the same manner as discussed above in connection with manual emptying of 50 pound bags of the pulverulent material into a carrier liquid containing vessel or into a material transferring or processing hopper. Thus, even in the case of large bulk bag transfer of the pulverulent material, it is desirable to provide means for preventing or significantly minimizing potential liberation of a quantity of the pulverulent material into the environmental air as the transfer process is being conducted.

SUMMARY OF THE INVENTION

It is a principal feature of the present invention to provide a novel system for achieving a mixture of a carrier liquid such as water and a flour-like pulverulent material as the material is being transferred from bags into the mixing or processing hopper of mixing apparatus and achieving mixing of the material with the liquid in a manner that minimizes the potential for liberation of the powder-like material into the environmental air.

It is an even a further feature of the present invention to provide a novel method and apparatus for emptying bags of pulverulent material into a processing hopper in such a manner that environmental air about the mixing processing facility will not become contaminated by airborne pulverulent material and so that an explosive mixture condition or a condition of potential hazard to workers cannot occur.

It is another feature of the present invention to provide a novel transferring and mixing system for finely pulverized solid material that has the capability, not only for mixing, but also for maintaining the quality of the mixture until it is needed in a manufacturing process.

It is another feature of the present invention to provide a novel transferring and mixing system for finely pulverized solid material which is provided with an electrically energized control system that provides for efficient operation of the transferring and mixing system and which, upon shut down of the system for any reason, subjects the mixing and mixture circulation system to a flushing or cleaning procedure before it can again be utilized for transferring and mixing activities.

Briefly, the various objects and features of the present invention are realized by the provision of mixing apparatus and a method for mixing wherein pulverulent material is discharged large bulk bags into a valve-controlled hopper in such manner that the hopper is maintained under a negative air pressure condition, i.e. suction, so that any pulverulent material that should be entrained in air within the hopper as dumping of the bulk bags occurs will be drawn by the negative air pressure through the metering valve of the hopper and into flowing liquid within a circulation conduit. The circulation conduit is in communication with a liquid mixture supply vessel for the liquid/pulverulent material mixture. The valve controlled discharge of the hopper is provided with a venturi through which the carrier liquid is circulated by means of a high shear centrifugal pump that is driven by an electric motor. As the liquid is pumped through the Venturi a condition of negative pressure, i.e. suction, is developed by the venturi and is communicated to the hopper, thereby insuring that air and pulverulent material within the hopper is drawn by suction through the venturi and into the circulation conduit. Thus, any pulverulent material that may be liberated into the air within the hopper will be moved by suction toward the bottom of the hopper. To accomplish such air movement, the hopper construction is designed to provide one or more air by-pass chambers or plenums into which environmental air is drawn by suction as the pulverulent material is fed from the bulk bag into the hopper. The air being drawn into the hopper is conducted by the air by-pass chambers to the immediate vicinity of the small bottom discharge opening of the hopper to minimize the potential for bridging of the pulverulent material within the hopper outlet and to enhance the steady flow of pulverulent material from the hopper and into the venturi of the liquid circulation conduit.

The mixing system is provided with a motor and valve control system including a control panel to permit manual selection of various operational sequences. Electrical circuitry within the control panel initiates and controls automatic opening and closing of inlet and outlet valves of the circulation conduit and for controlling a flush valve in a system flushing conduit through which clean liquid is introduced into the pump for flushing of the circulation conduit and for also controlling opening and closing of a metering valve of the hopper for controlling discharge of the pulverulent material from the hopper into the venturi of the circulation conduit. The electronic control system is provided with appropriate electronic lock-out circuitry that insures completion of the flushing cycle in the event the pump motor should be de-energized for any period of time. This feature insures that the mixing system cannot be activated for discharge of liquid mixture from the supply vessel under circumstances where some the particulate might have settled out of the mixture while the motor driven pump was de-energized.

The mixing system of the present invention is of such dimension and character that it may be easily mounted on a skid. The skid-mounted system may then be easily placed adjacent an existing mixing vessel and connected to it for proper operation within a very short period of time. Also, the skid-mounted system may be moved from place to place as is appropriate for the needs of the user.

BRIEF DESCRIPTION OF THE DRAWINGS

In the drawings:

FIG. 4 is a block diagram type electrical schematic illustration of the control circuitry of the unloading and mixing system of the present invention.

FIG. 6 is an elevational view showing the control panel for housing major components of the electronic control system of FIG. 5.

DETAILED DESCRIPTION OF PREFERRED EMBODIMENT

Figure 1:
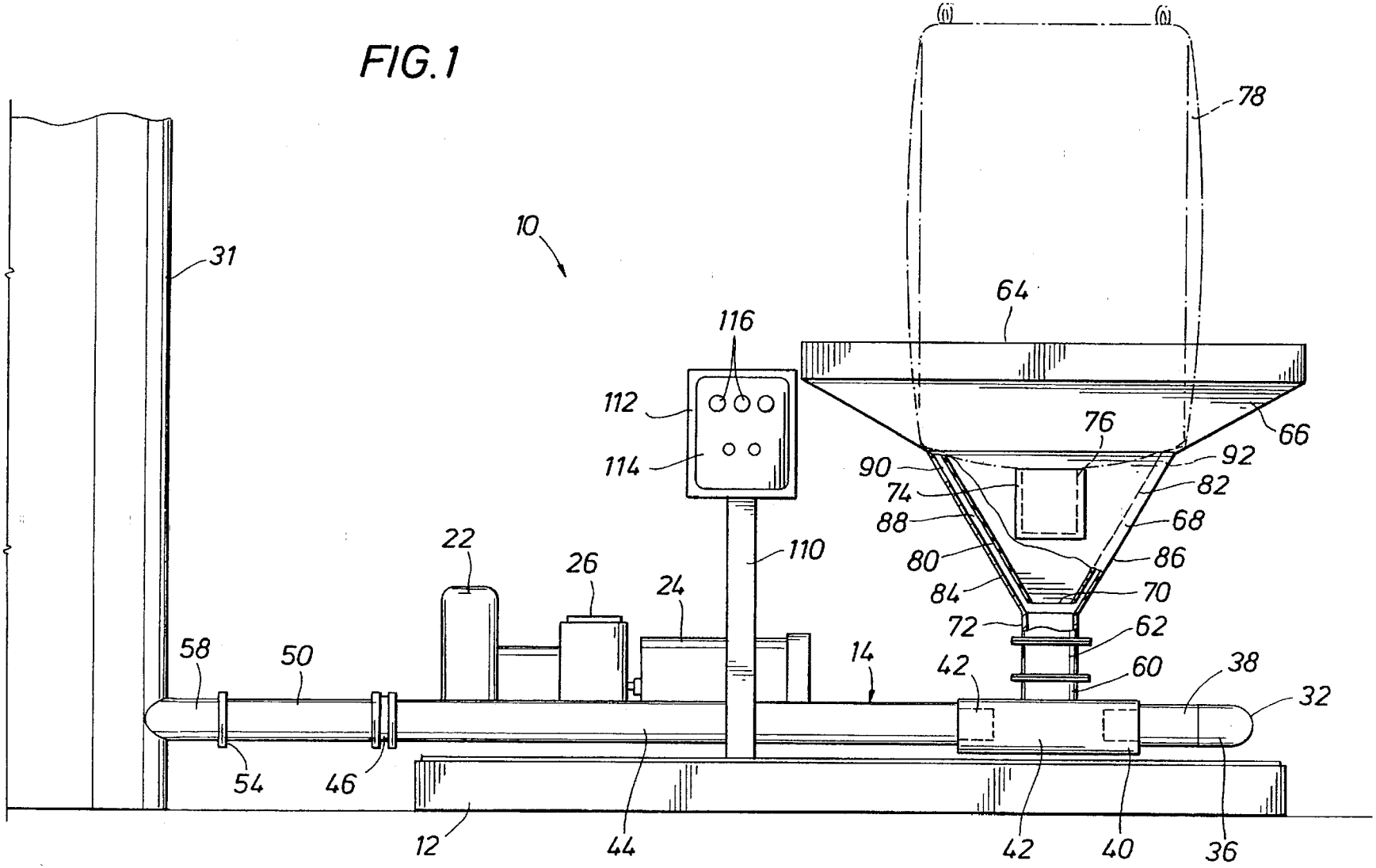
FIG. 1 is a side elevational view of a skid-mounted mixing system constructed in accordance with the features of the present invention and representing the preferred embodiment thereof.
Figure 2:
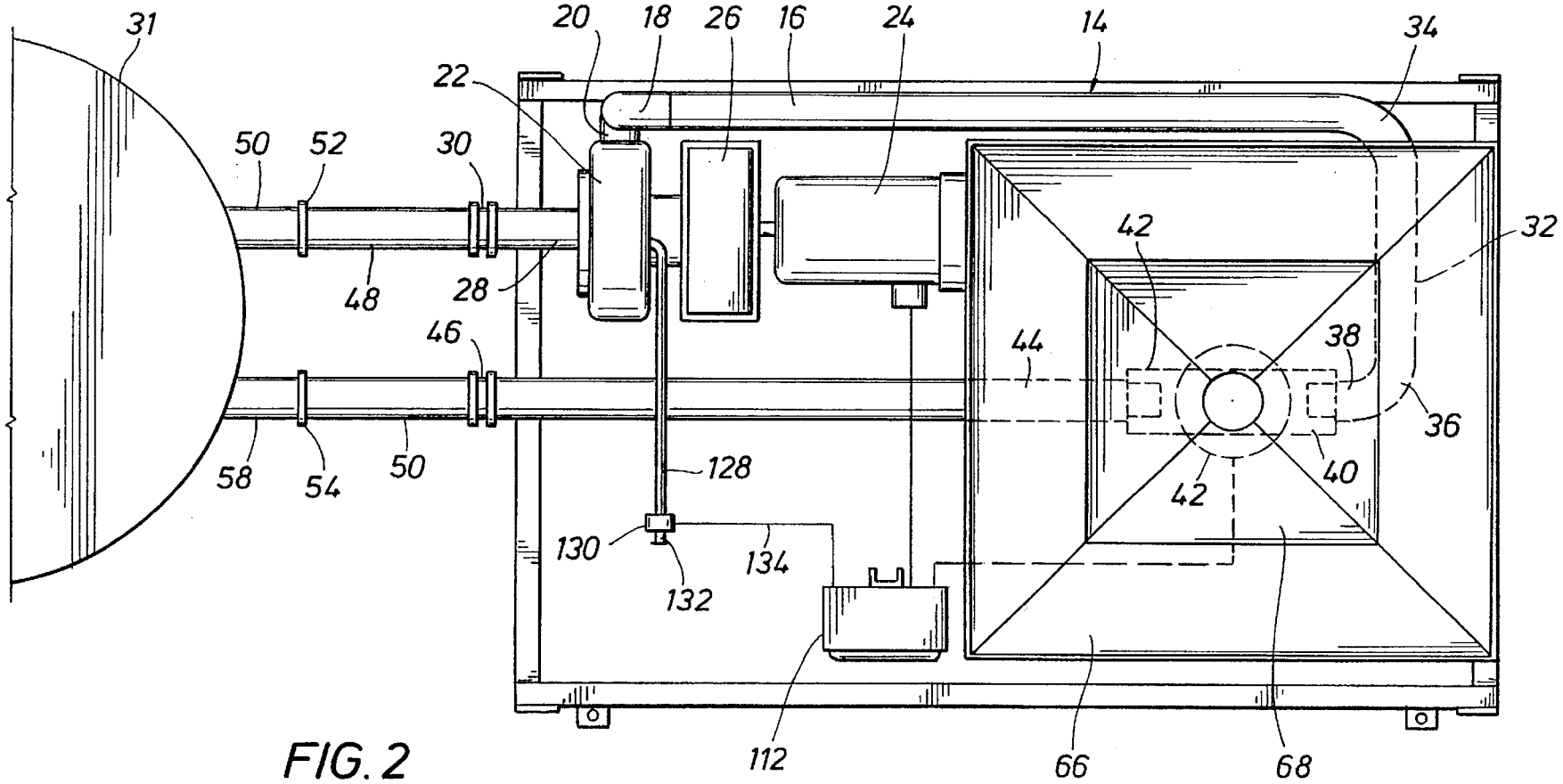
FIG. 2 is a plan view of the mixing system of FIG. 1 having parts thereof shown by way of broken lines.
Figure 3:
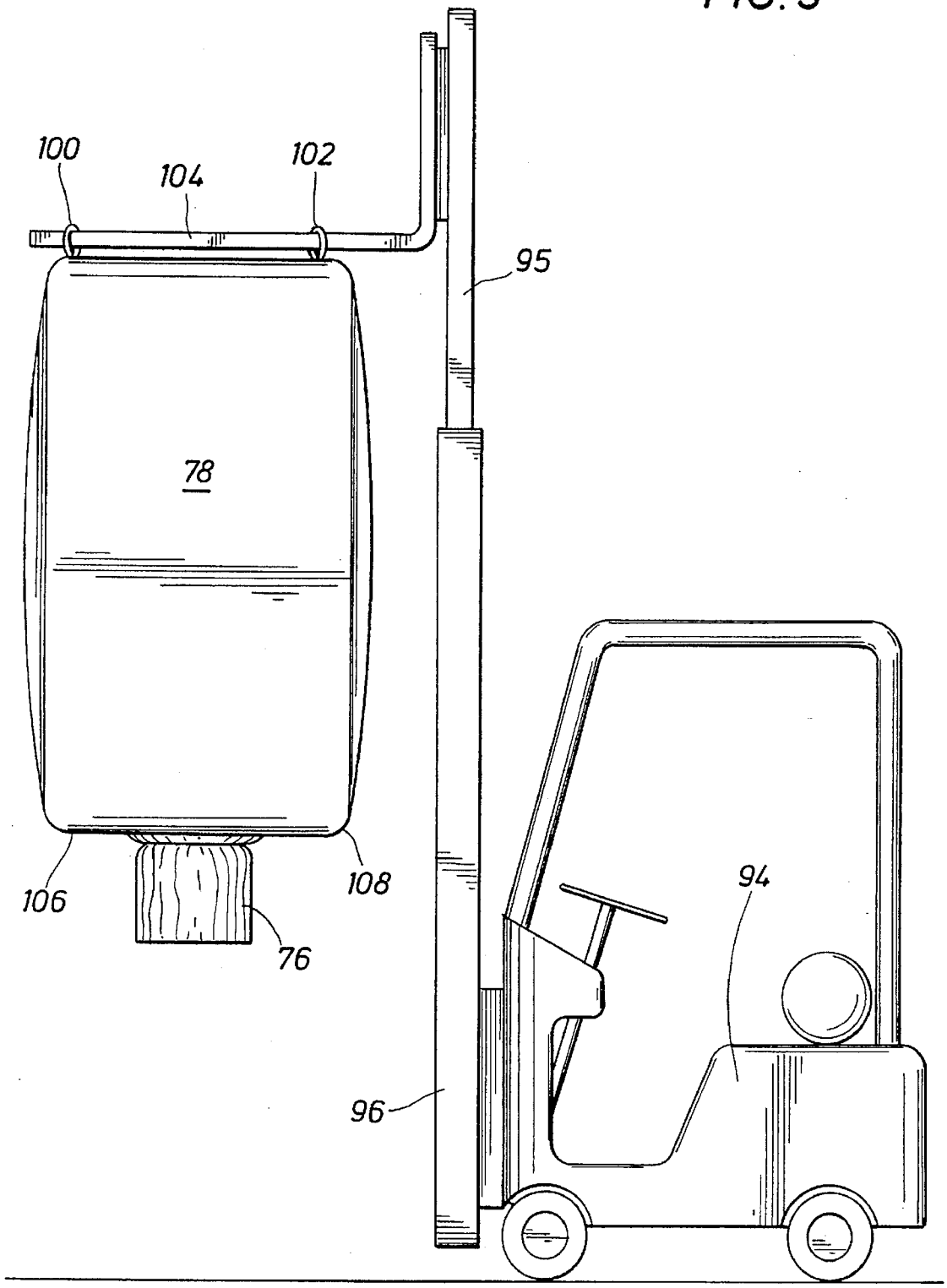
FIG. 3 is an elevational view showing a bulk bag being handled by a forklift apparatus.

Referring now to the drawings and first to FIGS. 1–3, a mixing system constructed in accordance with the principles of the present invention and being representative of the preferred embodiment is shown generally at 10 and is provided with a skid 12 that may be lifted and handled by hoist equipment, by a forklift vehicle or by any other suitable means. On the skid is mounted a circulation conduit shown generally at 14 and being in the form of a U-shaped conduit loop. The circulation conduit 14 employs a conduit section 16 having a pump connection 18 at one end thereof being connected to the discharge 20 of a high shear centrifugal pump 22 being driven by a rotary electric motor 24 through a pump gear train 26. The centrifugal pump 22 is provided with a pump inlet conduit 28 having a pump inlet valve 30 connected in controlling relation therewith. The pump inlet valve is typically an electrically controlled valve having a "fail-closed" condition in that upon pump failure for any reason the pump inlet valve will automatically return to its closed position.

The circulation conduit 14 is further provided with an end section 32 which is connected by a 90 degree conduit elbow 34 to the conduit section 16. The end section 32 is also connected by a 90 degree conduit elbow 36 to a venturi connection conduit section 38 which is connected to the inlet end 40 of a venturi 42. The circulation conduit 14 is also provided with a discharge conduit section 44 which is connected to the discharge end 46 of the venturi 42. The discharge conduit 44 is provided at its opposite end with a discharge valve 46 which is typically in the form of an electrically energized, fail closed valve similar to that of the pump inlet valve 30. Thus, upon failure of the mixing system for any reason the inlet end discharge valves 30 and 46 will become automatically closed, thereby shutting down communication of the circulation conduit with the liquid mixture and supply vessel 31. The control valves 30 and 46 are intended for connection to respective supply and discharge conduits 48 and 50 which are connected to conduit flanges 52 and 54 of vessel conduit sections 56 and 58. During operation of the mixing system, water or other liquid is drawn from the liquid mixture supply vessel 31 via conduit 48 and control valve 30 into the suction or inlet of the centrifugal pump 22. The liquid is then forced through the circulation conduit and passes through the venturi 42 where pulverulent material is mixed with it. The venturi 42 is provided with a pulverulent material inlet 60 to which is connected a pulverulent material metering valve 62. This metering valve is also an electrically energized fail dosed valve so that it will become automatically dosed in the event of failure of the mixing system for any reason. Additionally, the metering valve 62 may be suitably controlled to permit a desired volume of the pulverulent material to be drawn through the valve 62 and into the venturi 42 for mixing with liquid being circulated within the circulation conduit. For supply of pulverulent material to the control valve 62, there is provided a hopper shown generally at 64 which is generally of rectangular configuration and is provided with tapered sections 66 and 68 that terminate at a hopper discharge opening 70 having a hopper conduit 72 in connection with the metering valve member 62. The lower section 68 of the hopper is provided with an access opening 74 having an access cover to define its closure. The closure plate may be removed for any suitable reason to permit users to gain access to the interior of the hopper.

It is desirable to provide the hopper with means for developing a negative pressure condition within the hopper to thereby permit air and pulverulent material to be drawn downwardly through the hopper and through the metering valve into the venturi. This feature is desirable because it prevents the pulverulent material being discharged from the lower discharge section 76 of the bulk bag 78 from being liberated into the environmental air about the mixing system during discharge and thus minimizing the potential for the development of a potentially explosive pulverulent material/air mixture. Since the pulverulent material is of flour-like consistency, it can easily become entrained in the environmental air surrounding the mixing system. To overcome this disadvantage, the lower tapered hopper section 68 is provided with an air bypass system so that the negative pressure condition that is developed by the venturi during flow of liquid therethrough will draw environmental air downwardly into the hopper and through the metering valve into the venturi where it is mixed with liquid in preparation for its conveyance to the liquid mixture supply vessel along with the circulating liquid. The lower hopper section 68 is provided with one or more internal walls such as shown at 80 and 82 that are disposed in spaced relation with exterior hopper walls 84 and 86 and are sealed to the hopper wall at their upper ends so as to define air by-pass chambers that are closed to the hopper at their upper ends. It has been determined that the hopper apparatus will function properly when two opposed walls of the hopper are constructed to define internal wall sections that provide air bypass systems. These internal wall sections join with the wall of the hopper at their upper ends and may be interconnected with one another to form an inner hopper wall being spaced from the outer hopper wall and defining an air plenum or air passage 88 therebetween. By joining the internal wall sections with the wall of the hopper, the air bypass chambers or plenums will be closed at their upper ends so as to prevent entry of any pulverulent material from the hopper. The space between the double walls of the hopper which define the air plenums is also referred to herein as an air bypass passage. It should be borne in mind that the air bypass passage may conveniently take any other suitable form that conducts air from the environment externally of the hopper to the internal region of the bottom outlet of the hopper. The outer wall structure of the hopper will be provided with bypass air inlet openings such as shown at 90 and 92 which permit environmental air to be drawn through them into the air bypass passage or chamber 88. The internal walls 80 and 82 will terminate above the discharge opening 70 that is defined by the lower end of the lower hopper section. Thus, the air bypass passage or chamber 88 is open to the lower end of the hopper in the immediate region of the hopper discharge opening. Air being drawn through the air inlet openings 90 and 92 through the air bypass chamber, the hopper discharge opening and the metering valve into the venturi, by virtue of the negative air pressure, i.e., vacuum that is developed by the venturi, will assist the pulverulent material in flowing downwardly through the hopper and to the venturi. This continuous assisting air flow into the hopper, that is developed by the venturi during flow of liquid therethrough, also minimizes the possibility that any of the pulverulent material can be become entrained in the environmental air and leave the hopper and thus develop a potentially explosive environment.

As shown in FIG. 3, a fork lift truck 94 provided with a typical lift having lift sections 96 and 98 is utilized to handle large bulk bags such as that shown at 78. The bulk bags are provided with lifting loops such as shown at 101 and 102 that are received by a lift arm 104 of the hoist mechanism of the fork lift truck. Bulk bags are lifted in this manner and transported to the site of the mixing system and positioned so that outlet or discharge section 76 of the bulk bag is positioned well into the hopper with the discharge section 76 of the bag being located within the lower hopper section 68. The discharge closure of the bulk bag is then released, thereby allowing the pulverulent material to descend from the centrally located bag opening directly into the bottom of the hopper. Typically, only the lower portion of the bottom hopper section will become filled with pulverulent material when the pulverulent material is discharged into the hopper in this manner. This feature further minimizes the possibility that environmental air will become contaminated by the flour-like pulverulent material.

When large bulk bags of this nature are discharged into hoppers in the manner described above, the shoulder portions such as shown at 106 and 108 of the bulk bags can come into sealing contact with the internal wall surface of the hopper as shown in broken line in FIG. 2. When this occurs, the material of the bag can establish a seal within the hopper that constitutes a structural bridge preventing the pulverulent material within the bag from descending into the hopper. When this occurs, of course, the bulk bag must be lifted somewhat to break this bag's seal with the hopper and thereby prevent the contents of the bag to be discharged into the hopper. It should be expected that when the bulk bag is lifted in this manner the fine particulate binder material can be somewhat entrained in the air and can be released from the hopper. The present invention, however, prevents the bulk bag from bridging within the hopper and establishing a seal that prevents air interchange. If the bulk bag is positioned so that its shoulder portions 106 and 108 contact and seal against the inner tapered wall surfaces 80 and 82 of the hopper of this invention, air from the environment will nevertheless be drawn through the air inlet openings 90 and 92 into the air bypass chamber 88 where it is then permitted to flow into the hopper immediately above the discharge opening 70. This downward flow of air, under the influence of the suction that is developed by the venturi 42 as the liquid carrier flows through it, will assist in conveying the pulverulent material from the hopper into the venturi. Although the air by-pass chamber or chambers is shown and described herein as being defined by inner wall structure of the hopper, it should be born in mind that any suitable air by-pass arrangement may be employed that conducts environmental air from the exterior of the hopper directly to the bottom of the hopper under the influence of suction that is developed by the venturi. For example, a plurality of air by-pass tubes may be located along the internal wall structure of the hopper with their outlet openings arranged near the discharge opening of the hopper. Each of these by-pass tubes may then have the upper ends thereof open through the hopper wall to the environment externally of the hopper.

If liquid circulation within the circulation conduit and within the liquid mixture supply vessel should inadvertently stop for any reason, the particulate of the pulverulent material will tend to settle out of solution. When this occurs, of course, the liquid within the supply vessel will be of improper consistency for utilization in the process. It is desirable, therefore, in the event of electric motor failure or failure of power supply to the system that the system be rendered incapable of further conveyance of pulverulent material to the venturi and that all of the various valves of the system shift to their respective fail-closed positions. It is also desirable upon operation of the mixing system subsequent to power failure that the mixing system be subjected to a complete flushing cycle including introduction of clean liquid for agitation of any particulate that might have settled out of mixture within the mixing apparatus or within the supply vessel. Accordingly, to accomplish this feature the skid 12 is provided with a control panel support 110 having a control panel 112 supported thereby and portioned for actuation of the control panel circuitry that is shown in block schematic diagram in FIG. 4. The control panel 112 includes a panel face 114 having exposed thereon various control switch or contact buttons 116 that activate the circuitry thereof. As shown in FIG. 4 by way of block diagram, the control panel 112 includes control circuitry 118 having a motor control circuit 120 supplying electrical energy and control to a motor operation circuit 122. The control circuitry is also coupled via a positioning and operation circuit 124 to a product valve circuit 126. This circuit permits the product valve 62 to be positioned as is appropriate for metering pulverulent material from the hopper to the venturi. In the event of power failure or in the event of system shutdown for any reason, the control circuitry will cause the metering valve circuit to position the metering valve at its fail-closed position, preventing any further discharge of pulverulent material from the hopper.

For flushing of the mixing system, a flushing conduit 128 is in communication with the centrifugal pump 22 and is controlled by means of a flushing liquid valve 130 that is also of the fail-closed variety. The valve 130 is adapted for connection to any suitable supply of flushing liquid, typically the same liquid that is employed as the carrier agent, via a supply line 132. As shown in FIG. 4, the control circuitry 118 is provided with a control conductor 134 which is in controlling connection with a flush valve actuator 136 that is a component of the flush valve mechanism 130. In the event of power failure as described above, the control circuitry will cause the flush valve actuator to position the flush valve 130 at its fail-dosed mode. Likewise, inlet and discharge valve actuators 138 and 140 are controlled by the control circuitry 118 via control conductors 142 and 144 respectively. In the event of power failure, the inlet and discharge valve actuators will be controlled to position the respective inlet and discharge valves 30 and 46 at their respective closed positions.

OPERATION

The process for mixing the pulverulent material, PVA, starch, etc. with a liquid, typically water, begins with providing the liquid mixture supply vessel 31 with a quantity of the liquid from a suitable source. Since the mixing system will have been de-energized for a period of time, all of its valves 30, 46, 62 and 130 will be in their respective closed positions. The lockout circuitry of the control panel circuitry will prevent a normal mixing sequence under this condition. Since a quantity of the pulverulent material may have settled out of any liquid contained within the circulation conduit and the liquid mixture supply vessel 31 and more importantly within the pump housing where it may interfere with rotation of the pump impeller, it will appropriate to conduct a flushing sequence. This is accomplished by actuating the appropriate switch or contact button 116 of the control panel thus activating the flush sequence circuit 134 and causing opening of the flush valve 132 to admit a quantity of flushing liquid. Simultaneously, the pump inlet valve 30 will dose and the circulation discharge valve 46 will be opened by energization of their respective control circuits 142 and 144. Under this condition the centrifical pump 22 will remain deenergized by the motor circuit 120 so that the pump motor will not rotate the pump impeller with particulate sediment in the pump housing that could prevent the rotor from turning and stall or damage the pump motor and impeller drive mechanism. The product metering valve 62, under the flushing sequence, will remain closed to prevent discharge of pulverulent material from the hopper into the venturi. During the flushing sequence, flushing liquid will be circulated through the circulation conduit, centrifugal pump and venturi thereby causing any sediment of pulverent material therein to be flushed into the liquid mixture supply vessel. Circulation of flushing liquid, typically water, into the liquid mixture supply vessel will develop turbulence within the vessel causing any pulverulent material sediment therein to be returned to suspension within the liquid carrier agent. When the flushing sequence has been completed the circulation conduit will have been cleaned of any particulate sediment and will be in condition for a mixing cycle.

A bulk bag containing the product to be placed in slurry will then be lowered into the hopper until its lower shoulder portion is supported by the inclined walls of the hopper. When this is accomplished the bag will be substantially sealed with respect to the hopper and the pulverulent product will be quite unlikely to escape into the environmental air. A worker will then open the access door of the hopper, reach in and untie the cord that closes the bottom outlet opening of the bulk bag. The pulverulent product will then descend to the bottom of the hopper where it will be controlled by the product outlet and metering valve 62.

After the flushing sequence has been completed, in response to appropriate timing circuitry of the control panel, the process "run" portion of the control panel circuitry may then be energized by manual activation of the control circuitry simply by manual activation of the "run" sequence of the control circuitry. When the "run" sequence is energized by the control circuitry, the product valve actuator 126 will be appropriately energized by its control circuit 124 thereby opening the product valve 62 to its preset position for optimum metering of pulverulent material from the hopper through the product valve to the venturi 42. Feed of pulverulent product through the metering valve 62 will continue until manual actuation of the control circuit 124 will close the metering valve 62. This will ensure delivery of a measured quantity of the pulverulent material into the circulation conduit for mixing with the liquid being circulated therein. The turbulence that is developed across the venturi will accomplish mixture with the circulating liquid in the range of about 90% of completion. As liquid circulation continues from the circulation conduit into the liquid mixture supply vessel and back to the high shear type centrifugal pump 22, mixing of the pulverulent material with the liquid carrier continues. As the mixture is then circulated back through the high shear centrifugal pump 22, the mixing process will have been completed. To maintain an efficient mixture and to prevent any settling of the particulate from the liquid carrier, after the metering valve 62 has been closed, the centrifugal pump will remain energized and the valves 30 and 46 will remain open. This will permit the turbulence and mixing characteristics of the centrifugal pump to maintain an optimum mixture within the supply vessel and within circulation conduit until such time as the liquid has been withdrawn from the supply vessel and transferred to the process.

If during the mixing sequence, the mixing apparatus should be shut down for any reason, i.e. typically electrical power failure, the control circuitry will not permit the "run" sequence to begin until such time as the "flush" sequence has been initiated and completed.

Figure 5:
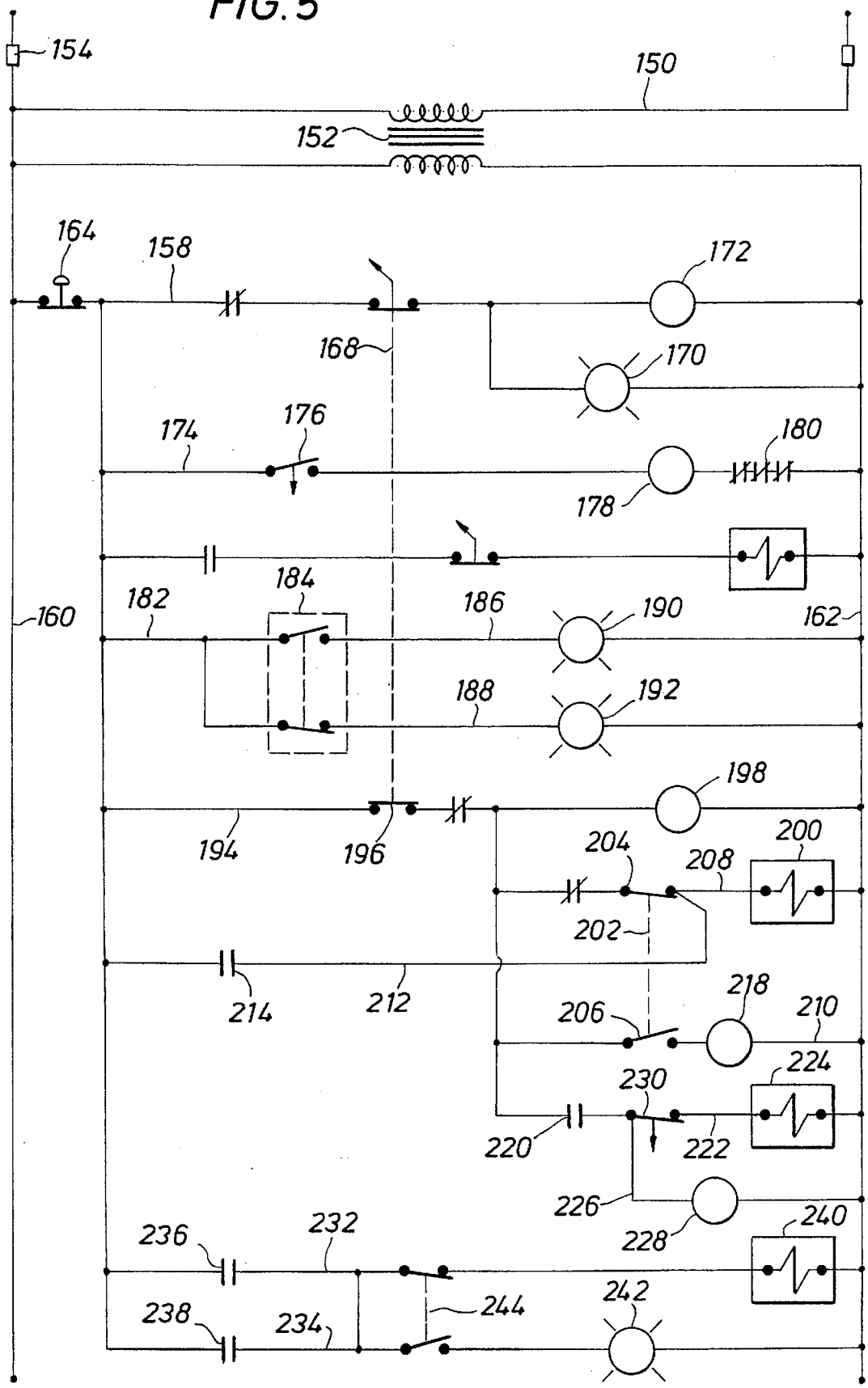
FIG. 5 is an electronic schematic illustration of the electronic control circuitry of the unloader/mixer apparatus of the present invention.

Referring now to FIGS. 5 and 6, which present the electronic control circuitry of unloader/mixer apparatus constructed in accordance with the present invention, the electronic schematic circuitry of FIG. 5 shows a power supply circuit 150 having a 440 v to 120 v ac transformer 152 that is coupled to line voltage across a circuit breaker 154 which may take the form of a power disconnect shown at 156 of the control panel 157 of FIG. 6. A power circuit 158 connected to line conductors 160 and 162 is provided with an emergency stop switch 164 that may take the form of a push/pull switch as shown at 166 on the control panel. The circuit 158 is provided with a normally dosed time delay contact TD2 and one contact of a pump-on switch 168 having a "pump on" indicator light 170 on the control panel which is illuminated when the pump circuit is energized. The pump power circuit is energized for the duration of a cleaning or flushing cycle as determined by the setting of a time delay relay 172. A motor starter circuit 174 is provided with a time delay switch 176 of the time delay relay 172 and includes a motor starter relay 178 that is actuated for energization of the motor by line voltage. This circuit is provided with overload protection via an overload thermal protector 180.

For control of the product valve 62, shown in FIG. 1, a valve control circuit is provided at 182 having a double pole product limit switch 184 controlling energization of "open" and "closed" light circuits 186 and 188 each having a control panel signal light 190 and 192 respectively which are illuminated to indicate the open or dosed condition of the product valve 62. During the flushing sequence of the unloader/mixer apparatus it is desirable that the water inlet valve and the water flush valve be controlled by a timing sequence. Accordingly, the control circuitry is provided with a flushing sequence timing circuit 194 which is energized upon closure of the contact 196 of the pump-on switch 168. Thus, when the flushing sequence timing circuit is energized, the motor control circuit will be deenergized so that the centrifugal pump cannot be started until such time as the time delay cycle of the flushing circuit has run to its completion. This circuit is provided with a time delay relay 198 having timing control of the water inlet valve 200 via a double pole time delay switch 202 having switch contacts 204 and 206 for controlling energization of circuits 208 and 210. A circuit 212 that is coupled with the water inlet valve control circuit 208 is provided with a normally open contact 214 of the time delay solenoid 172 so that the circuit is energized only when the solenoid 172 is actuated. This feature causes the water inlet valve to also be controlled by the pump-on circuit 158 as well as the solenoid 198. The relay 198 is provided with a normally closed contact 216 which is opened to deenergize the pump-on circuit 158 when the solenoid 198 has been actuated. Circuit 210 is in turn provided with a time delay relay which, when activated, accomplishes closure of a normally open contact 220 of a water flush valve circuit 222 for controlling actuation of a water flush valve solenoid 224. Another time delay circuit 226 is controlled by a time delay relay 228 across normally closed switch contact 230 when the contact 220 is closed by time delay relay 172.

A water outlet valve circuit 232 and a cleaning or flushing cycle complete circuit 134 are coupled across normally open relay contacts 236 and 238 of relays 172 And 198 respectively for control of a water outlet valve solenoid 240 and a signal light 242 depending upon the position of a double pole relay switch 244 that is controlled by the time delay relay 228. The above circuit description and operation of the control circuitry provides for manually controlled operation of the unloader/mixer system of the present invention and also provides appropriate "lock-out" and time delay circuitry to ensure that the system can operate for unloading and mixing activities only when the pump, circulation conduit and venturi of the system have been subjected to a complete cleaning cycle and is therefore free of product sediment that may be present due to the length of down time between cycles of operation or due to deenergization for the pump motor circuit for any period of time.

In view of the foregoing it is apparent that a novel mixing system for mixing a flour-like particulate material with a liquid carrier agent has been provided which provides for efficient mixing, provides for maintenance of the mixture in proper character for use and which also provides for protection of workers that are involved in the mixing process. It is therefore apparent that this invention is one well adapted to achieve all of the various objects and features that have been set forth above as well as other objects and features that are inherent in the apparatus and process of this invention. While the invention has been explained in terms of a particularly advantageous embodiment, it will be understood by those skilled in the art that various changes may be made in the structures and process described herein without departing from the spirit and scope of this invention and that the scope of this invention is intended to be defined by the appended claims.

What is claimed is:

1. A liquid mixing, conveying and circulating system for pulverulent material for mixing with a liquid in preparation for use, comprising:

(a) a liquid mixture supply vessel from which a liquid/pulverulent material mixture is periodically withdrawn for use, said liquid supply vessel having a mixture circulation inlet and a mixture circulation outlet;

(b) a hopper having hopper wall means and a charging opening for receiving pulverulent material said hopper having a pulverulent material discharge opening;

(c) air bypass means for conducting air through said hopper to said discharge opening and being arranged to prevent blockage of air flow by pulverulent material and thus ensure flow of the pulverulent material from said hopper through said pulverulent material discharge opening and to direct air flow into said charging opening and to said discharge opening for transporting any air entrained particulate near said charging opening into said hopper;

(d) a liquid circulating conduit having inlet and discharge ends for circulating connection with the circulation inlet and outlet of said liquid mixture supply vessel; and (e) a circulation pump being located in said liquid circulating conduit and upon being energized, continuously circulating liquid/pulverulent material mixture from said liquid mixture supply vessel, through said liquid circulating conduit and back to said liquid mixture supply vessel; and (f) mixing means being located in said liquid circulating conduit and having a pulverulent material inlet being connected in receiving relation with said pulverulent material discharge opening of said hopper, said pulverulent material being mixed with liquid being circulated within said liquid circulating conduit by said circulation pump responsive to flow of said liquid therethrough.

2. The liquid mixing, conveying and circulating system of claim 1, wherein:

(a) a pulverulent material metering valve being interposed between said pulverulent material discharge opening of said hopper and said mixing means; and (b) means for selectively positioning said metering valve for controlled feed of the pulverulent material from hid pulverulent material opening to said mixing means.

3. The liquid mixing, conveying and circulating system of claim 1, wherein said air bypass means comprising:

air bypass wall means being located within said hopper and in spaced relation with said hopper wall means, the space between said hopper wall means and said air bypass wall means defining at least one air passage having an air inlet located above the level of pulverulent material within said hopper and having at least one air outlet located near said pulverulent material discharge opening of said hopper.

4. The liquid mixing, conveying and circulating system of claim 1, wherein said air bypass means comprising:

(a) said hopper having a plurality of inclined, generally triangular hopper walls and defining said charging opening at the upper end thereof and defining said pulverulent material discharge opening at the lower end thereof;

(b) at least one generally triangular air bypass wall being located within said hopper and being disposed in spaced relation with at least one of said generally triangular hopper walls and cooperating therewith for defining an air flow passage having an air bypass opening located above the maximum level of pulverulent material within said hopper and having an air bypass discharge opening located adjacent said pulverulent material discharge opening of said hopper, said air bypass wall being oriented for contact by the lower end of a flexible pulverulent material supply bag; and (c) said mixing means causing mixing of bypassed air and the pulverulent material with said liquid upon flow of said pulverulent material and bypassed air into said liquid circulation conduit from said pulverulent material inlet thereof.

5. The liquid mixing, conveying and circulating system of claim 1, wherein said mixing means comprises:

(a) a venturi mechanism having a flow passage in communication with said liquid circulating conduit;

(b) a restriction being defined within said flow passage; and (c) a venturi product inlet being defined by said venturi and being in communication with said pulverulent material discharge opening of said hopper, said venturi mechanism, responsive to the flow of liquid therethrough under the influence of said pump, developing a negative pressure at said venturi product inlet causing flow of pulverulent material and causing flow of air from said hopper through said venturi mechanism and into said circulation conduit.

6. The liquid mixing, conveying and circulating system of claim 1, wherein:

(a) a flushing liquid conduit being in communication with said circulation pump and being adapted for connection with a supply of flushing liquid; and (b) a flush valve being connected in said flushing liquid conduit and being selectively opened to admit flushing liquid to said circulation pump for pumping into said liquid circulation conduit.

7. The liquid mixing, conveying and circulating system of claim 1, wherein:

said liquid circulating conduit having electrically energized inlet and discharge valves therein being located respectively at said inlet and discharge ends of said liquid circulating conduit, said inlet and discharge valves being open during circulation of liquid/ pulverulent material mixture within said liquid circulating conduit and said liquid mixture supply vessel.

8. The liquid mixing, conveying and circulating system of claim 7, wherein:

(a) a flushing liquid conduit being in communication with said circulation pump and being adapted for connection with a supply of flushing liquid; and (b) an electrically energized flush valve being connected in said flushing liquid conduit and being selectively opened to admit flushing liquid to said circulation pump for pumping into said liquid circulation conduit.

9. The liquid mixing, conveying and circulating system of claim 8, wherein:

(a) said circulation pump having an electrically energized pump motor;

(b) a pulverulent material metering valve being interposed between said pulverulent material discharge opening of said hopper and said mixing means; and (c) electrically energized means for selectively positioning said pulverulent material metering valve for controlled feed of the pulverulent material from said pulverulent material opening to said mixing means; and (d) electrical control means being in operative and controlling connection with said electrically energized inlet and discharge valves, said electrically energized flush valve, said electrically energized pump and said electrically energized means for positioning said pulverulent material metering valve, said electrical control means having a mixing cycle and a cleaning sequence and controlling opening and closing of all valves, upon deenergization of said pump motor prior to completion of a mixing cycle said electrical control means closing all valves and starting said cleaning sequence, said electrical control means preventing opening of any of said closed valves until said cleaning cycle has run to its completion.

10. The liquid mixing, conveying and circulating system of claim 9, wherein said cleaning sequence comprising:

(a) opening said flush valve for admission of flushing liquid to said electrically energized pump;

(b) opening said inlet and discharge valves of said liquid circulation conduit to permit pump energized circulation of liquid in said liquid circulation conduit and in said liquid mixture supply vessel; and (c) maintaining said pulverulent material metering valve closed during said cleaning sequence to prevent admission of pulverulent material into said mixing means.

11. A liquid mixing, conveying and circulating system for pulverulent material being delivered in large flexible bags for mixing with a liquid in preparation for use, comprising:

(a) a liquid mixture supply vessel from which a liquid/pulverulent material mixture is periodically withdrawn for use, said liquid mixture supply vessel having a mixture circulation inlet and a mixture circulation outlet;

(b) a pulverulent material hopper having hopper wall means and a charging opening for receiving pulverulent material from the large flexible bags, said hopper having a pulverulent material discharge opening;

(c) a liquid circulating conduit having inlet and discharge ends for circulating connection with the circulation inlet and outlet of said liquid mixture supply vessel;

(d) a circulation pump being located in said liquid circulating conduit and upon being energized, continuously circulating liquid/pulverulent material mixture from said liquid mixture supply vessel, through said liquid circulating conduit and back to said liquid mixture supply vessel;

(e) a venturi type liquid/pulverulent material mixer being located in said liquid circulating conduit and having a flow passage with a venturi restriction through which liquid flows under the influence of said pump and a pulverulent material inlet being connected in receiving relation with said pulverulent material discharge opening of said hopper and being in communication with said flow passage at said venturi restriction, said pulverulent material being mixed with liquid by the shearing effect and turbulence of liquid being pumped through said flow passage by said circulation pump;

(f) a pulverulent material metering valve being interposed between said pulverulent material discharge opening of said hopper and said pulverulent material mixer; and (g) means for selectively positioning said metering valve for controlled feed of the pulverulent material from said pulverulent material opening to said pulverulent material mixer and;

(h) air bypass means being defined by said hopper for conducting air to said discharge opening during/low of the pulverulent material from said hopper through said pulverulent material discharge opening.

12. A method for unloading a pulverulent material from a bulk bag and mixing the same to a slurry with a liquid carrier, comprising:

(a) providing unloading and mixing apparatus having a hopper with tapered hopper walls and a bottom outlet opening having a product outlet valve, said hopper further having an access opening and an access door normally closing said access opening and having an air by-pass system in communication with the bottom outlet opening, a liquid circulation conduit having high shear centrifugal pump and a venturi, said venturi having a product inlet in communication with said product outlet valve and having a flow passage in communication with said liquid circulation conduit, said unloading and mixing apparatus further having a slurry vessel in valve controlled communication with said liquid circulation conduit;.

(b) lowering a bulk bag having a bottom outlet being tied with a closure and containing pulverulent material into said hopper until the bulk bag rests upon said tapered hopper wall and the bottom outlet of the bulk bag extends into the hopper;

(c) opening said access door;

(d) untying the bulk bag closure and permitting pulverulent material to descend to the bottom portion of the hopper;

(e) closing said access door;

(f) introducing liquid carrier into said circulation conduit;

(g) starting said high shear centrifugal pump to initiate liquid carrier circulation in said circulation conduit and through said venturi;

(h) opening said product outlet valve of said hopper and causing the pulverulent material to be moved to said venturi by gravity and by suction developed by liquid carrier flow through said venturi;

(i) said mixing being accomplished by turbulence of liquid carrier within said venturi and by mixing action of said high shear centrifugal pump; and (j) conducting the resulting carrier liquid/pulverulent material slurry to said slurry vessel.

* * * * *